United States Patent [19]

Iwase

[11] Patent Number: 4,674,421

[45] Date of Patent: Jun. 23, 1987

[54] SEWING MACHINE

[75] Inventor: Yukio Iwase, Utsunomiya, Japan

[73] Assignee: Iwase Prince Kabushiki Kaisha, Japan

[21] Appl. No.: 790,842

[22] Filed: Oct. 24, 1985

[30] Foreign Application Priority Data

Nov. 2, 1984 [JP] Japan ..... 59-232021

[51] Int. Cl.[4] ..... D05B 69/24; D05B 11/00; D05B 21/00

[52] U.S. Cl. ..... 112/121.12; 112/118; 112/275

[58] Field of Search ..... 112/117, 118, 121.11, 112/121.12, 275

[56] References Cited

U.S. PATENT DOCUMENTS

| | | | |
|---|---|---|---|
| 4,325,313 | 4/1982 | Kawai et al. | 112/121.12 |
| 4,365,564 | 12/1982 | Sugiyama | 112/121.12 |
| 4,373,458 | 2/1983 | Dorosz et al. | 112/121.12 |
| 4,512,269 | 4/1985 | Bowditch | 112/121.12 |
| 4,574,718 | 3/1986 | Scholl et al. | 112/121.12 |
| 4,586,123 | 4/1986 | Plassmeier | 112/121.11 X |

*Primary Examiner*—Wm. Carter Reynolds
*Attorney, Agent, or Firm*—Darby & Darby

[57] ABSTRACT

A sewing machine has a rotatable machine head and a bobbin drive unit which is rotated in synchronism with the machine head. The machine head and a needle reciprocally movably mounted on the machine head are independently driven through coaxially disposed inner and outer shafts. The reciprocal movement of the needle is detected by a detector mounted on the machine head. When only the machine head is required to be rotated, the shaft for driving the needle is also rotated so that the needle is held in its top dead point.

4 Claims, 6 Drawing Figures

SEWING MACHINE

BACKGROUND OF THE INVENTION

Field of the Invention

This invention relates generally to a sewing machine and, more particularly, to a sewing machine suitable for use in quilting beddings or the like.

Some of industrial sewing machines for use in sewing-up of bed quilts or the like are provided with a sewing machine head having a needle, a bobbin unit and a working table disposed at a position downward of the machine head for supporting a workpiece such as a bed quilt or the like so as to be interposed between the machine head and the bobbin unit. Such a kind of sewing machine is constituted so as to stitch various kinds of decorative patterns by horizontally moving the working table in its X and Y directions. Some of such sewing machines present an excellent sewing efficiency when the direction of the machine head and bobbin unit thereof are controlled so as to always coincide with the sewing direction in order to beautifully sew a complicated pattern.

One example of such machine head and bobbin unit will be described with reference to FIG. 1. In FIG. 1, a machine head 1*a* is rotatably mounted on a horizontally extending hollow arm portion 2*a* of a machine body 2, the arm portion 2*a* being of a square cross-section. A pulley 3*a* is fixedly mounted on a hollow shaft 4*a* which is fixedly secured to the machine head 1*a* and rotatably mounted on the arm portion 2*a* through a bearing 5*a* and a collar 6*a*. A drive force of a head drive motor (not shown in FIG. 1) is transmitted to the pulley 3*a* through a belt 7*a* to rotate the machine head 1*a* about an axis of the hollow shaft 4. A shaft 8*a* of less diameter than the shaft 4*a* is disposed coaxially of and rotatably mounted on the hollow shaft 4*a*. Fixedly mounted on the upper end of the inner shaft 8*a* is a pulley 9*a* which is rotated by a needle drive motor (not shown in FIG. 1) through a belt 10*a*. The rotation of the inner shaft 8*a* is transmitted through a pulley mounted on the lower end thereof (not shown) and a belt 11 to a pulley 12 which is fixedly mounted on a shaft 13 extending perpendicularly to the shaft 8*a*. The rotation of this horizontally disposed shaft 13 is transmitted to an input shaft of a well-known crank mechanism which vertically reciprocally moves a needle 14 slidably mounted on the machine head 1*a*.

A bobbin drive unit 1*b* is provided below the machine head 1*a*. The bobbin drive unit 1*b* is rotatably mounted on another horizontally extending arm portion 2*b* of the body 2. The bobbin drive unit 1*b* is rotated about an axis of an outer shaft 4*b* by the head drive motor through a belt 7*b* and a pulley 3*b* in synchronism with the machine head 1*a*. The internal mechanism of the bobbin drive unit 1*b* is driven by the needle drive motor through a belt 10*b*, a pulley 9*b* and an inner shaft 8*b*. A workpiece such as a bedding to be quilted is interposed between the machine head 1*a* and the bobbin drive unit 1*b* with the peripheral portion thereof secured to a working table in the form of a frame (not shown in FIG. 1).

The sewing machine with the aforesaid arrangement has such a disadvantage that when the direction of the machine head 1*a* is changed by actuating the head drive motor with the needle drive motor stopped, the needle 14 vertically moves due to the relative rotational movement of the inner shaft 8*a* to the outer shaft 4*a*. In other words, the needle 14 vertically reciprocally moves in accordance with the difference between the rotations of the inner shaft 8*a* and the outer shaft 4*a*.

On the other hand, when the sewing operation is changed from a sewing operation for a certain decorative pattern to that for another decorative pattern which is not continuous with the former pattern (i. e., in the case of what is called "skip sewing") or in the case of a tracing operation wherein a sewing program is tested by moving the machine head 1*a* and the working table in the same manner as the actual sewing operation without driving the needle drive motor, the needle 14 must be held in its elevated position irrespective of the rotational movement of the head 1*a* to prevent the workpiece from being damaged.

To prevent this movement of the needle 14, the conventional sewing machine has been equipped with a clutch mechanism to transmit the drive force of the head drive motor to the inner shaft 8*a* so that the inner shaft 8*a* is rotated in synchronism with the machine head 1*a*. In this manner, the relative rotational movement of the inner shaft 8*a* to the machine head 1*a* has been prevented.

However, the use of the clutch mechanism lowers the reliability of the sewing machine due to possible slip of the clutch which may occur as a result of the aged deterioration of the clutch. Also, the use of the clutch mechanism causes a risk that a workpiece can be damaged when the work table is moved under such condition that the clutch is connected when the needle is not sufficiently raised.

SUMMARY OF THE INVENTION

It is therefore an object of the present invention to provide a sewing machine in which a needle can be held in its top dead point irrespective of the rotation of a machine head thereof.

According to the present invention, there is provided a sewing machine comprising a body; a machine head having a needle reciprocally movably mounted thereon; coaxially disposed inner and outer shafts, one of the shafts being fixedly connected to the machine head at one end thereof and mounted on the body at the other end thereof so as to be rotatable about an axis thereof, the other of the shafts being operatively connected at one end thereof to the needle so that the needle reciprocally moves within a stroke in accordance with the rotation of the the other of the shafts; bobbin drive unit rotatably mounted on the body in spaced opposed relation to the machine head, the bobbin drive unit being operatively connected to the machine head for rotating in synchronism therewith; first motor means mounted on the body and operatively connected to the one of the shafts for rotation thereof; second motor means mounted on the body and operatively connected to the the other of the shafts for rotation thereof; detection means for detecting the reciprocal movement of the needle to output a detection signal; and control means programmed to individually drive the first and second motor means to effect a sewing operation, the control means being responsive to the detection signal for driving the second motor means so that the needle is held in a predetermined position within the stroke when the sewing operation is not effected.

DESCRIPTION OF THE PREFERRED EMBODIMENT OF THE INVENTION

Figure 1:
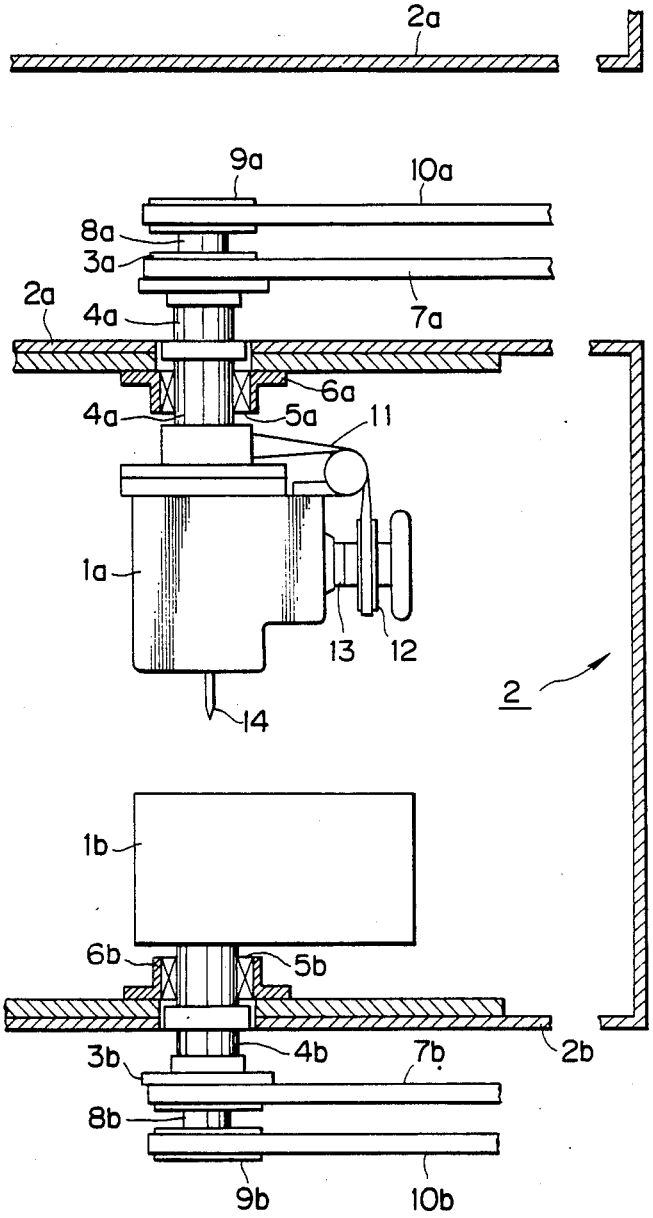
FIG.1 PRIOR ART
FIG. 1 (prior art) is a front elevational view of a machine head and a bobbin drive unit which are rotatably mounted on a machine body.

An embodiment of the invention will now be described in detail with reference to the accompanying drawings in which like reference numerals denote corresponding parts in several views.

Figure 2:
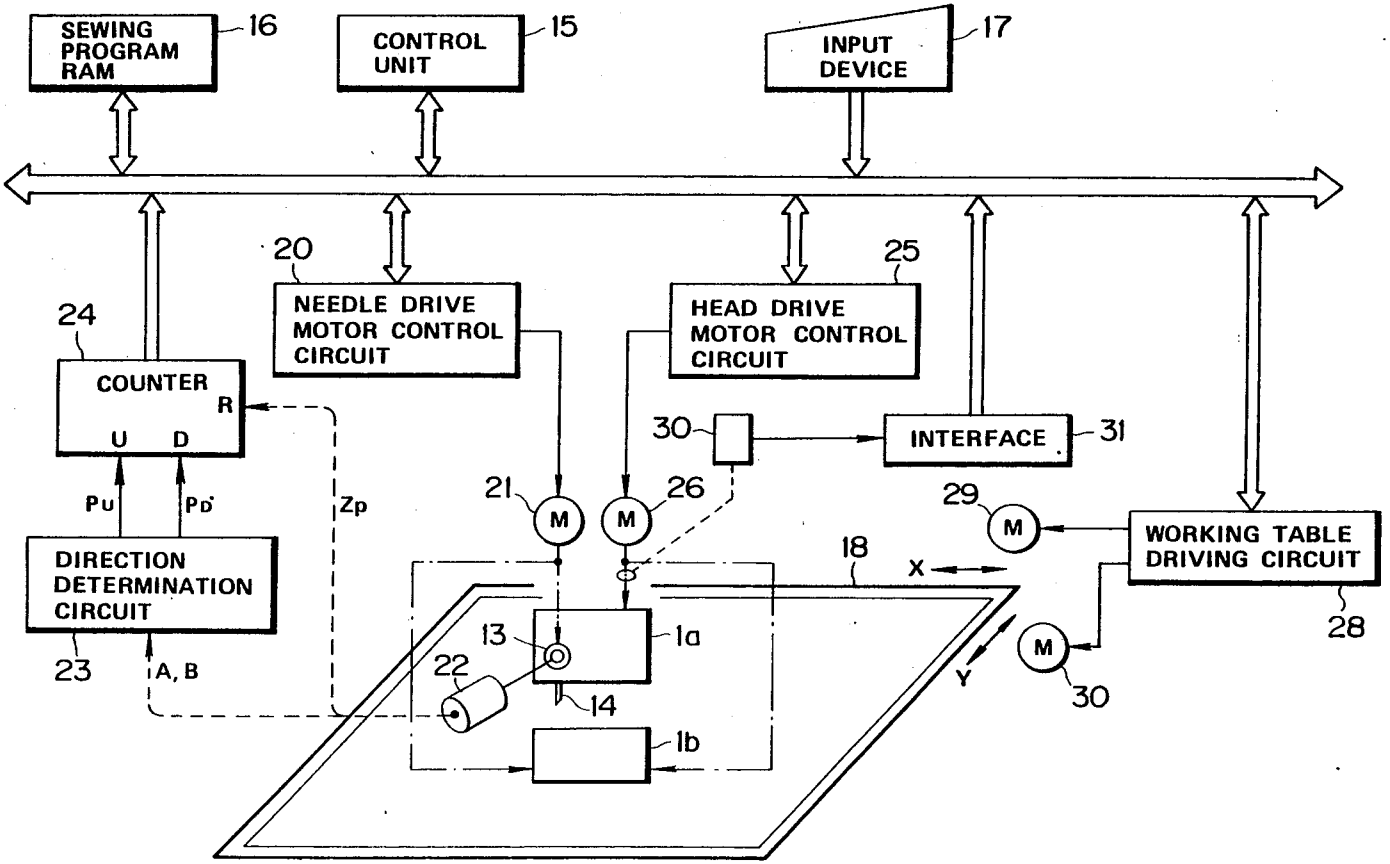
FIG. 2 is a block diagram of a sewing machine provided in accordance with the present invention.
Figure 3:
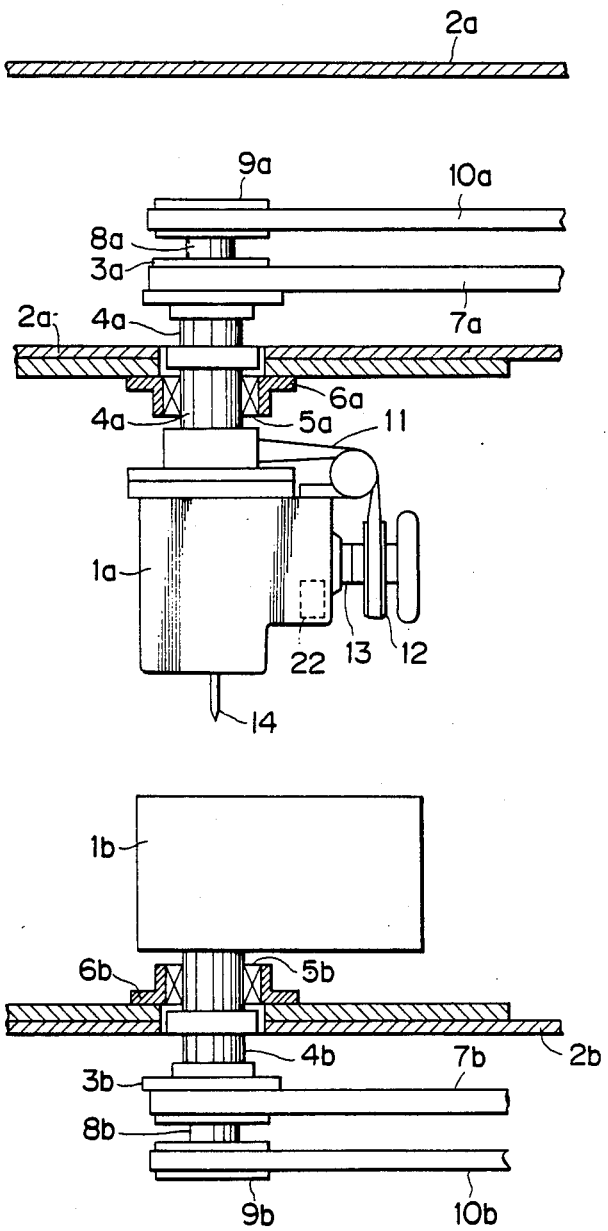
FIG. 3 is a front elevational view of the machine head and the bobbin drive unit of the sewing machine of FIG. 2.

In FIG. 2, there is shown a control unit 15 which comprises a CPU (central processing unit), a ROM storing a control program and a RAM for storing temporary data. This control unit 15 may be constituted by a well-known microprocessor and controls various portions of this sewing machine as more fully described hereunder. A sewing program RAM 16 stores a sewing program data which is programmed by the operator and includes data relating to various sewing patterns and sewing procedures. An input device 17 comprises a ten-key and various function keys for selecting one of a plurality of operation modes of the control unit 15. The operation modes include (1) a tracing operation mode, (2) an automatic sewing mode in which an automatic sewing operation is performed in accordance with the sewing program data stored in the sewing program RAM 16, and (3) a manual operation mode in which the movement of a working table 18 in the form of a frame, the direction of a machine head 1*a* and the reciprocal movement of a needle 14 are controlled step by step. A needle drive motor control circuit 20 drives a needle drive motor 21 under the control of the control unit 15, and the rotation of the motor 21 is transmitted to a pulley 9*a* through a belt 10*a* as well as a pulley 9*b* through a belt 10*b*, as shown in FIG. 3. The construction of the machine head 1*a* and the bobbin unit 1*b* differs from that shown in FIG. 1 in that a rotary encoder 22 of two-phase output type is provided within the machine head 1*a*. The rotary encoder 22 is coupled to the horizontal shaft 13 of the machine head 1*a* to detect the rotational movement of the shaft 13. The rotation of the shaft 13 corresponds to the vertical movement of the needle 14, so that the number of the two-phase (phases A and B) output pulses of the encoder 22 represents the vertical position of the needle 14. The A-phase pulse and the B-phase pulse are 180° displaced from each other. The encoder 22 is also so arranged that a pulse ZP is generated when the needle 14 is located at its top dead position. A direction determination circuit 23 determines the direction of rotation of the shaft 13 in accordance with the relation of the A-phase and B-phase pulses. When the direction of the rotation is determined to be forward (the forward rotation is performed in the normal sewing operation), the direction determination circuit 23 outputs a pulse PU to an input terminal U of a counter 24. On the other hand, when the direction of the rotation is determined to be reverse, the direction determination circuit 23 outputs a pulse PD to an input terminal D of the counter 24. The counter 24 counts up the pulse PU and counts down the pulse PD. The counter 24 is supplied at a reset terminal thereof the pulse ZP from the encoder 22, so that the contents of this counter 24 are cleared each time the needle 14 passes the top dead point thereof. Thus, the contents of the counter 24 always represent the current vertical position of the needle 14.

A head drive motor control circuit 25 drives a head drive motor 26 under the control of the control unit 15. The rotation angle of the machine head 1*a* is detected by a detector 30 such as a rotary encoder similar to the encoder 22, and the output of the detector 30 is converted into digital data by an interface 31 similar in construction to the direction determination circuit 23 and the counter 24. The digital data is thence supplied to the control unit 15 to form a feed back control loop. A working table driving circuit 28 drives a pair of motors 29 and 30 under the control of the control unit 15. In this case, the motor 29 moves the working table 18 in the X direction, while the motor 30 moves the table 18 in the Y direction.

Figure 4:
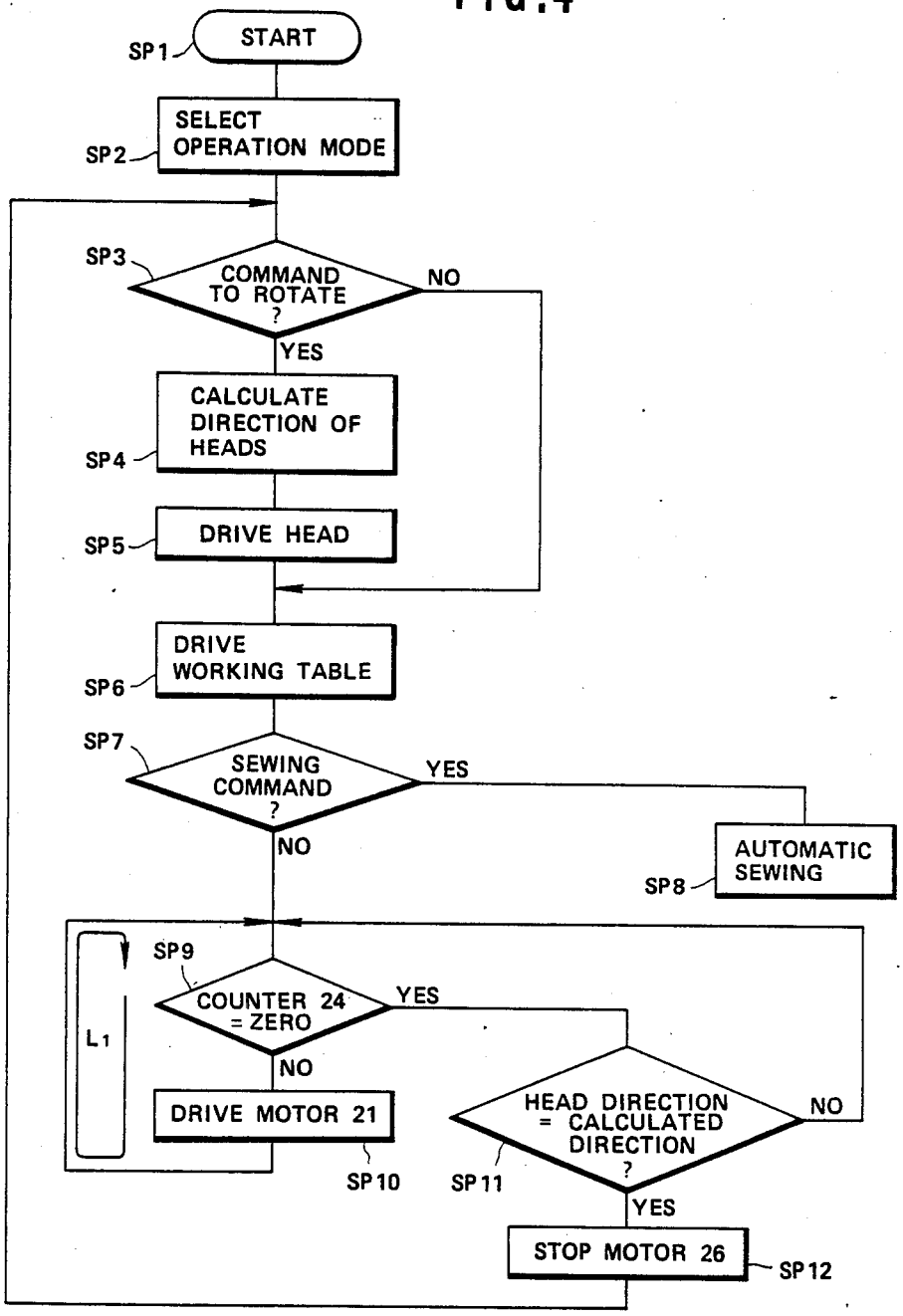
FIG. 4 is a flow chart showing the operation of the sewing machine of FIG. 2.

The operation of this sewing machine will now be described with reference to a flow chart shown in FIG. 4.

When the sewing machine is started to operate, the mode of operation is first selected by reading the output of the input device 17 (block SP1 and SP2). At block SP3, it is determined whether a command to rotate the machine head 1*a* exists. If the determination is "YES", the processing proceeds to block SP4. On the other hand, if the determination result is "NO", the processing proceeds to block SP6. At the block SP4, the direction of the machine head 1*a* is calculated in the following manner. For example, it is assumed that a pattern to be stitched is a circle, the direction of the machine head 1*a* is repeatedly calculated in accordance with the movement of the working table 18 in such a manner that the direction of the machine head 1*a* is always in alignment with the tangential line of the circle at the current sewing position. On the other hand, if the angle data is directly inputted from the input device 17, the above calculation is not performed, and the inputted angle data is stored. At the next block SP5, the machine head drive motor 26 begins to be rotated in accordance with the above calculation results or the stored angle data. More specifically, the control unit 15 supplies control signals representative of the results obtained at the block SP4 to the machine head motor control circuit 25 so that the control circuit 25 drives the motor 26 in accordance with the control signals. At the next block SP6, the working table 18 is driven in accordance with the stitch pattern outputted from the sewing program RAM 16 or in accordance with data inputted from the input device 17. More specifically, the control unit 15 supplies control signals representative of the pattern data or the data from the input device 17 to the working table driving circuit 28 so that the driving circuit 28 drives the motors 29 and 30 in accordance with the control signals. At block SP7, it is determined whether a sewing command exists. If the determination result is "YES", an automatic sewing processing is carried out at block SP8, and the needle drive motor 21 is driven at a speed corresponding to the sewing pitch. On the other hand, if the determination result at the block SP7 is "NO", the processing proceeds to blocks SP9 to SP12 wherein a synchronization processing is carried out. The determination result at the block SP7 becomes "NO" in any one of the following cases, namely, (1) in the case of the tracing operation mode, (2) in the case of the skip sewing and (3) in the case where the command to rotate the machine head 1 without performing sewing operation is generated from the input device 17.

The synchronization processing at the blocks SP9 to SP12 will now be described.

Figure 5:
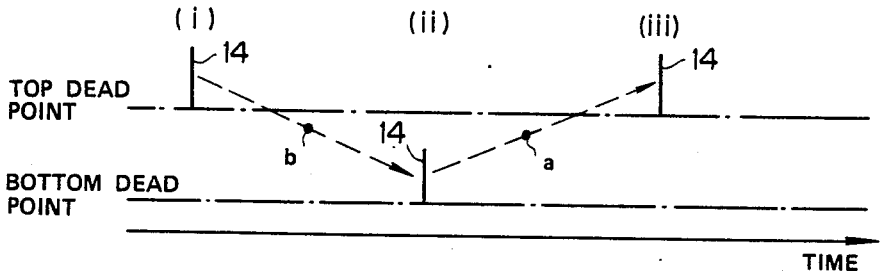
FIG. 5 is an illustration showing the movement of the needle 14 of the sewing machine of FIG. 2.
Figure 6:
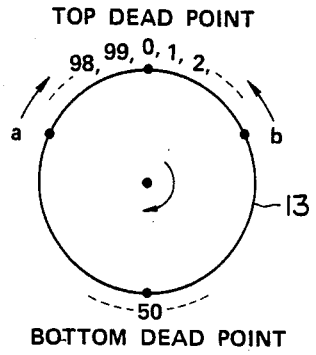
FIG. 6 is an illustration showing the relation between the contents of the counter 24 and the rotation angle of the shaft 13 of the sewing machine of FIG. 2.

At the block SP9, it is determined whether the content of the counter 24 is "0", that is to say, whether the needle 14 is positioned at its top dead point. If the determination result is "NO", the processing proceeds to the block SP10 at which the motor 21 is driven so that the content of the counter 24 becomes "0". It is assumed that when the needle 14 is moved from the top dead point (shown at (i) in FIG. 5) to the bottom dead point (shown at (ii) in FIG. 5) and thence to the top dead point (shown at (iii) in FIG. 5), the rotation angle of the shaft 13 and the contents of the counter 24 vary as shown in FIG. 6 wherein the contents of the counter 24 vary from "0" to "99". In this case, if it is detected that the needle 14 is presently located at a vertical position corresponding to an angular position a of the shaft 13 as shown in FIG. 6, the motor 21 is driven so that the shaft 13 is rotated in the forward direction to elevate the needle 14 to the top dead point. On the other hand, if it is detected that the needle 14 is presently located at a vertical position corresponding to an angular position b of the shaft 13 as shown in FIG. 6, the motor 21 is driven so that the shaft 13 is rotated in the reverse direction to elevate the needle 14 to the top dead point. Thus, the motor 21 is driven so that the needle 14 is moved to the top dead point along the shortest path. Upon completion of the processing at block SP10, the processing returns to the block SP9 at which it is again determined whether the contents of the counter 24 are equal to "0". The processing is repeatedly carried out as indicated by a loop L1 in the flow chart until the determination result at the block SP9 becomes "YES". When the determination result at the block SP9 becomes "YES", the processing proceeds to step SP11 at which it is determined whether the direction of the machine head 1*a* coincides with the direction calculated or stored at the block SP4. If the determination result at the block SP11 is "NO", the processing returns to the block SP9. The reason for this is that even if the content of the counter 24 once becomes "0" during the time when the machine head 1*a* continues to rotate, the content of the counter can be deviated from "0" thereafter. And, if the content of the counter 24 thus deviates from "0", the motor 21 is again driven so that the inner shaft 8*a* is rotated in synchronism with the machine head 1*a* thereby to maintain the needle 14 in the top dead position. When the determination result at the block SP11 becomes "YES", the processing proceeds to block SP12 at which the motor 26 is stopped. Then, the processing returns to the block SP3 at which it is again determined whether the command to rotate the machine head 1*a* exists. And thereafter, the above operation is repeated.

With the above embodiment, the vertical position of the needle 14 is detected by the rotary encoder 22. However, in place of this encoder 22, a detecting member may be attached to the outer periphery of the shaft 13 so that a contactless switch, a photo sensor or the like detects the detecting member to detect the vertical position of the needle 14.

What is claimed is:

1. sewing machine comprising:

(a) a body;

(b) a machine head having a needle reciprocally movably mounted thereon;

(c) coaxially disposed first and second shafts, said first shaft being fixedly connected to said machine head at one end thereof and mounted on said body at the other end thereof so as to be rotatable about axis thereof, said second shaft being operatively connected at one end thereof to said needle so that said needle reciprocally moves within a stroke in accordance with the rotation of said second shaft relative to said first shaft;

(d) bobbin drive unit rotatably mounted on said body in spaced opposed relation to said machine head, said bobbin drive unit being operatively connected to said machine head for rotating about said axis of said first shaft in synchronism with said machine head;

(e) first motor means mounted on said body and operatively connected to said first shaft for rotation thereof;

(f) second motor means mounted on said body and operatively connected to said second shaft for rotation thereof;

(g) detection means for detecting the reciprocal movement of said needle to output a detection signal; and (h) control means programmed to individually drive said first and second motor means to effect a sewing operation, said control means being responsive to said detection signal for driving both said first and second motor means so that said needle is held in a predetermined position within said stroke when said sewing operation is not effected.

2. A sewing machine according to claim 1, wherein said predetermined position of said needle is that position within said stroke which is the farthest from said bobbin drive unit.

3. A sewing machine according to claim 1, wherein said detection means is a rotary encoder mounted on said machine head and operatively connected to said second shaft.

4. A sewing machine according to claim 1, wherein said control means comprising a microprocessor.

* * * * *